US005184401A

United States Patent [19]

Hirose et al.

[11] Patent Number: 5,184,401

[45] Date of Patent: Feb. 9, 1993

[54] METHOD OF ASSEMBLING VALVE DRIVE MECHANISM TO ENGINE

[75] Inventors: Ichiro Hirose; Masahiro Choshi; Kouichi Hatamura, all of Hiroshima, Japan

[73] Assignee: Mazda Motor Corporation, Hiroshima, Japan

[21] Appl. No.: 798,248

[22] Filed: Nov. 26, 1991

[30] Foreign Application Priority Data

Nov. 30, 1990 [JP] Japan ..... 2-339570
Nov. 30, 1990 [JP] Japan ..... 2-339575

[51] Int. Cl.[5] ..... F01L 1/34

[52] U.S. Cl. ..... 29/888.01; 29/428; 123/90.27

[58] Field of Search ..... 29/888.01, 428; 123/90.27, 90.16

[56] References Cited

U.S. PATENT DOCUMENTS 4,502,427 3/1985 Skelly ..... 123/90.27
4,539,951 9/1985 Hara et al. ..... 123/90.27
4,570,334 2/1986 Melger et al. ..... 29/888.07
4,572,118 2/1986 Baguina ..... 123/90.27
4,714,057 12/1987 Wichant ..... 123/90.27
4,957,079 9/1990 Nakatani et al. ..... 123/90.27
5,052,351 10/1991 Nishimura et al. ..... 123/90.27
5,123,385 1/1992 Sado et al. ..... 123/90.27

FOREIGN PATENT DOCUMENTS 62-191636 8/1987 Japan .

*Primary Examiner*—Irene Cuda
*Attorney, Agent, or Firm*—Keck, Mahin & Cate

[57] ABSTRACT

A method of assembling a valve driving mechanism, having a variable valve timing unit incorporated in a cylindrical mounting base, to a dual overhead camshaft engine. The engine has camshafts which are rotatably connected by camshaft gears. The method includes the initial step of mounting one camshaft gear, maintained at a predetermined angular position relative to the other camshaft gear attached to the other camshaft, and a lock nut on the one camshaft. Subsequent steps include first adjusting the angular position of the mounting base relative to the one camshaft gear and then the angular position of the variable valve timing unit relative to the one camshaft, and fastening the one camshaft gear to the mounting base by the lock nut and, simultaneously, the variable valve timing unit to the one camshaft.

4 Claims, 3 Drawing Sheets

METHOD OF ASSEMBLING VALVE DRIVE MECHANISM TO ENGINE

BACKGROUND OF THE INVENTION

1. Field of the Invention

This invention relates to a method of assembling a valve drive mechanism in an internal combustion engine and, more particularly, to a method of assembling a valve drive mechanism with a variable valve timing feature in an internal combustion engine.

2. Description of Related Art

Since the advanced development of internal combustion engines, it has been recognized that greater power output and efficiency can be achieved if intake and exhaust valve operations can be varied as a function of an engine operating condition such as engine speed. Engines typically have a timing belt provided between an engine crankshaft and either an intake or an exhaust camshaft, operationally coupled to each other by camshaft gears attached to the respective camshafts. In this manner, intake and exhaust valves are driven. One way to accomplish a variation in valve timing in such engines is to vary the phase of rotation of one camshaft relative to the other. Such a variable valve timing mechanism is known from, for instance, Japanese Unexamined Patent Publication No. 62-191636.

During assembly of the valve drive mechanism with a variable valve timing feature to an engine, because various rotational elements of the valve drive mechanism must be "well timed", i.e., operate at particular times relative to one another, installing the camshaft gear in the variable valve timing mechanism attached to one of the intake and exhaust camshafts typically is troublesome. In order for the intake and exhaust valves to open and close at proper times, the relative rotation phases of the intake and exhaust camshafts must be adjusted. For phase adjustment of the camshafts, it is necessary to adjust a predetermined relative angular position existing between the camshaft gears of the intake and exhaust camshafts and between the variable valve timing mechanism and both the camshaft and the camshaft gear which cooperate with the variable valve timing mechanism.

When making such an adjustment in relative angular position for phase adjustment by, for instance, a pin-and-slot type connection or engagement, if a lock means, such as a lock nut or a lock bolt, is used to fasten the camshaft gear to the variable valve timing mechanism or the variable valve timing mechanism to the camshaft, insufficient pin-and-slot engagement may occur. If insufficient pin-and-slot engagement does occur, the pin-and-slot engagement can break down completely. Accordingly, misadjustment of the relative phase of rotation between the intake and exhaust camshafts can be caused. Such misadjustment results in insufficient engine performance. Moreover, making a relative angular position adjustment two or more times decreases the efficiency with which assembling work is performed.

SUMMARY OF THE INVENTION

It is, therefore, an object of the present invention to provide a method of assembling a variable valve timing mechanism and a camshaft gear to a camshaft which improves the phase of rotation adjustment occurring between the camshaft gear and the variable valve timing mechanism and the efficiency with which the camshaft gear and the variable valve timing mechanism may be assembled to the camshaft.

This object is accomplished by providing a method of assembling a valve driving mechanism, having a variable valve timing unit incorporated in a cylindrical mounting base, to one of two overhead camshafts which are rotatably connected to each other by camshaft gears. In the method of assembling the valve driving mechanism of the present invention, for example, the exhaust camshaft gear, which is maintained at a predetermined angular position relative to the intake camshaft gear attached to the intake camshaft, and a lock nut are mounted on the exhaust camshaft. While mounting the variable valve timing unit on the exhaust camshaft, an angular position adjustment is made first for the mounting base relative to the exhaust camshaft gear and then for the variable valve timing unit relative to the exhaust camshaft. The exhaust camshaft gear and the variable valve timing unit are simultaneously fastened to the mounting base and the exhaust camshaft, respectively, by the lock nut and a fastening bolt.

The exhaust camshaft gear is provisionally fastened to the mounting base by the lock nut after the adjustment of the angular position of the mounting base, and is completely fastened, simultaneously with the fastening of the variable valve timing unit, to the mounting base by the lock nut after adjustment of the angular position of the variable valve timing unit.

According to another aspect of the present invention, in the method of assembling the valve driving mechanism to the double overhead camshaft engine, the exhaust camshaft, with the exhaust camshaft gear and the lock nut mounted thereon, is placed on a semi-circular bearing formed integrally with a cylinder head of the engine. A semi-circular bearing cap is attached to the semi-circular bearing to form a cylindrical space between the bearing and the exhaust camshaft. Before simultaneously fastening the exhaust camshaft gear and the variable valve timing unit to the mounting base and the exhaust camshaft by the lock nut and a fastening bolt, the exhaust camshaft gear is held in the cylindrical space. Then, the mounting base is inserted into the cylindrical space so as to mount the variable valve timing unit on the exhaust camshaft. Before inserting the mounting base into the cylindrical space, a sealing ring is attached to the semicircular bearing to provide a seal between the bearing and the mounting base.

BRIEF DESCRIPTION OF THE DRAWINGS

Other features of the present invention will be apparent to those skilled in the art from the following description of a preferred embodiment of the invention when considered with reference to the accompanying drawings, in which.

DESCRIPTION OF THE PREFERRED EMBODIMENT

Figure 1:
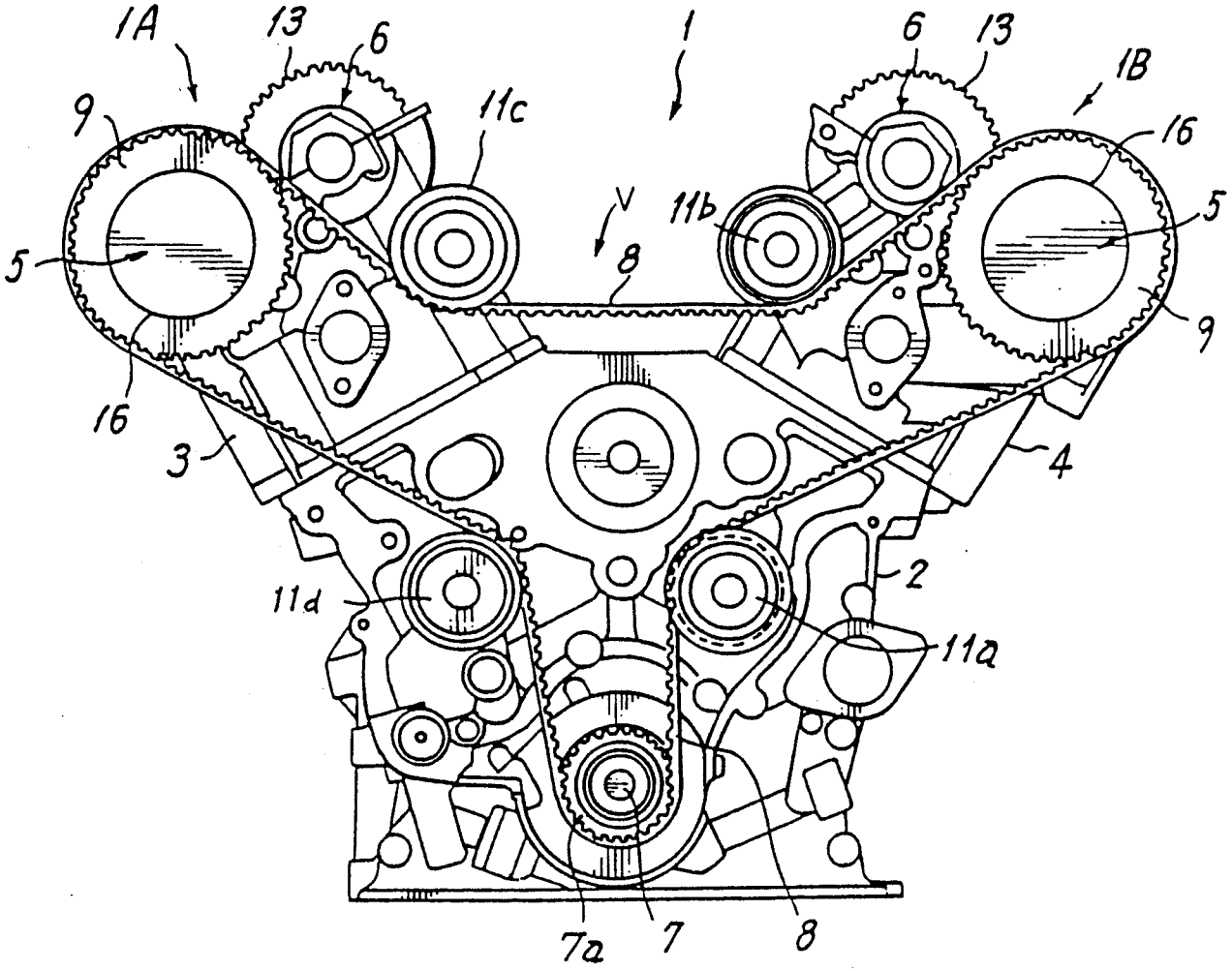
FIG. 1 is a front view of a V-type internal combustion engine to which a valve drive mechanism including a variable valve timing unit is assembled according to the method of the present invention.

Referring to the drawings in detail and, in particular, to FIG. 1, an internal combustion engine 1, such as a V-type internal combustion engine, equipped with a valve drive mechanism assembled by the method of the present invention is shown. The engine 1 includes a right or first cylinder bank IA and a left or second cylinder bank IB. The first and second cylinder banks IA and IB have first and second cylinder heads 3 and 4 mounted on a cylinder block 2. The cylinder heads are disposed in a V-formation at a proper angle (for instance, about 60 degrees) relative to each other so as to form a V-shaped space V therebetween. The engine 1 has a plurality of cylinders disposed adjacent to one another and along the length of the cylinder banks 1A and 1B. Each of these cylinders has four valves, namely, two intake valves and two exhaust valves. A pair of camshafts, namely, exhaust and intake camshafts 5 and 6, form a part of the valve drive mechanism. These camshafts are rotatably disposed parallel to each other on cylinder heads 3 and 4. Each of the pairs of camshafts 5 and 6 is rotatably connected to an engine crankshaft 7 by a timing belt 8 so as to be driven at approximate relative timings. In more detail, the crankshaft 7, which extends out of one end of a lower portion of the cylinder block 2, is provided, at its outer end, with a crankshaft pulley or sprocket 7*a* coaxial with the crankshaft 7. The exhaust camshafts 5, which extend out of first ends of the cylinder heads 3 and 4, respectively, are provided, at their outer ends, with camshaft pulleys or sprockets 9 coaxial with the exhaust camshafts. These sprockets 7*a* and 9 are connected by the timing belt 8. To apply a proper constant tension to the timing belt 8, there are several idler pulleys 11*a*–11*d* located at selected points. The exhaust and intake camshafts 5 and 6 are rotatably connected by an interconnecting gear train. The gear train includes an exhaust camshaft gear 12, rotatably mounted on the exhaust camshaft 5, and an intake camshaft gear 13 (see FIG. 3), mounted on the intake camshaft 6 so as to be rotated at an appropriate timing relative to the crankshaft 7. The intake camshaft gear 13 is accompanied by a friction gear 17 (see FIG. 3) mounted on the intake camshaft 6.

The exhaust camshaft 5 is provided with two cams 5*a* for each cylinder, and the intake camshaft 6 is also provided with two cams (not shown) for each cylinder. These cams drive the intake and exhaust valves so that they open and close intake and exhaust ports of the cylinder at a proper timing.

Figure 2:
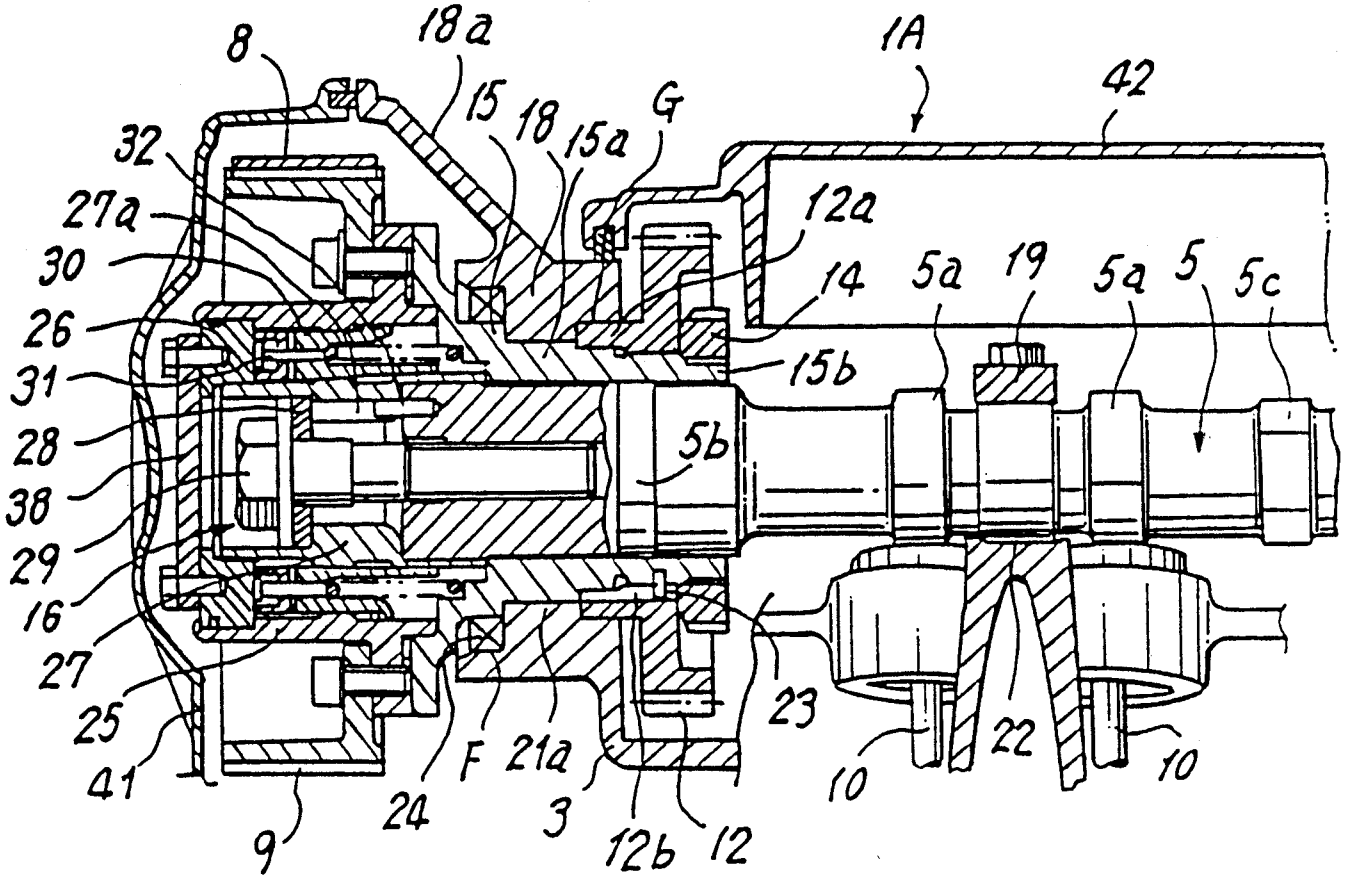
FIG. 2 is a cross-sectional view of an essential part of the V-type internal combustion engine of FIG. 1.
Figure 3:
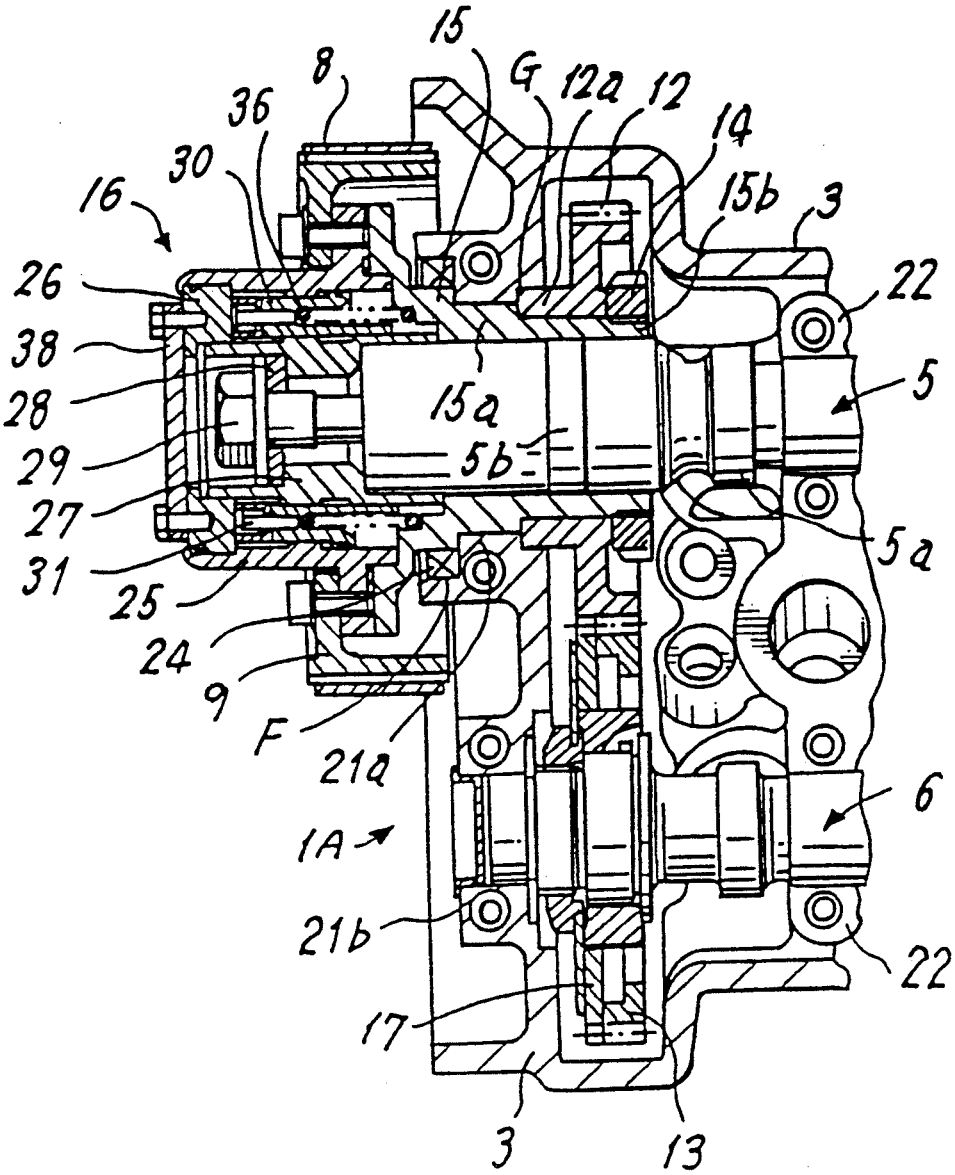
FIG. 3 is a cross-sectional view of an essential part of the valve drive mechanism assembled in one cylinder bank of the V-type internal combustion engine of FIG. 1.

Referring to FIGS. 2 and 3, and specifically to the area around the exhaust camshaft 5, there is disposed, between the camshaft pulley 9 and the exhaust camshaft 5, a variable valve timing mechanism 16 for varying a timing of opening and closing the exhaust valves relative to the intake valves so as to vary valve opening overlap time between the intake and exhaust valves. The variable valve timing mechanism 16 is mounted on the exhaust camshaft 5 by a generally cylindrically shaped mounting base 15. The mounting base 15 is attached to the camshaft sprocket 9 by bolts at its front end and to the exhaust camshaft gear 12 by a lock nut 14 at its rear end. To mount the camshafts 5 and 6 on the cylinder head 3 in cooperation with an end bearing cap 18 and an intermediate bearing cap 19, the cylinder head 3 is formed, on its top surface, with end bearings 21*a* and 21*b* for supporting the cylindrical mounting base 15 and intermediate bearings 22 for supporting intermediate journal portions of the camshafts 5 and 6. The end bearing cap 18 is formed with a front cap extension 18*a* extending around a half portion of the camshaft sprocket 9.

The cylindrical mounting base 15 is made as one integral piece and has three portions, namely, a front cylindrical flange portion with internal steps, one of which is attached with the camshaft pulley 9 through a cylindrical casing 25, an intermediate cylindrical journal portion 15*a* which is held by the end bearing 21*a* and the end bearing cap 18, and a rear cylindrical with an externally threaded end 15*b*. The intermediate journal portion 15*a* has an external diameter smaller than the front flange portion and larger than the rear cylindrical portion so as to form front and rear external shoulders. The cylindrical mounting base 15 abuts, at the front shoulder, against the front end surface of the end bearing 21*a* and the end bearing cap 18. The exhaust camshaft gear 12 has a cylindrical boss 12*a*, abutting, at its front end, against the rear shoulder of the intermediate journal portion 15*a* of the cylindrical mounting base 15, and is fixedly supported between the rear shoulder of the intermediate journal portion 15*a* and the lock nut 14 threadingly fitted to the externally threaded end 15*b* of the rear cylindrical portion. The cylindrical boss 12*a* is further rotatably supported in a cylindrical space formed between annular shoulders G of the end bearing 21*a* and the end bearing cap 18 so as to prevent the cylindrical mounting base 15 from thrust movement with respect to the end bearing 21*a*.

There is a positioning means for adjusting the cylindrical mounting base 15 and the exhaust camshaft gear 12 to a predetermined relative angular position. The positioning means includes a positioning pin 23, radially projecting from the rear cylindrical portion of the cylindrical mounting base 15, and an internal axial slot 12*b*, formed in the exhaust camshaft gear 12. The end bearing 21*a* and the end bearing cap 18 are formed with semi-circular grooves F, respectively, in which an oil sealing ring 24 is fitted. A timing belt cover 41 is attached to the front bearing cap extension 18*a* of the end bearing cap 18 to cover various elements, including the timing belt 8, mounted directly and indirectly on the front end portion of the exhaust camshaft 5. A head cover 42 is attached to the rear end of the end bearing cap 18 to cover the top surface of the cylinder head 3 and the camshafts 5 and 6.

The exhaust camshaft 5 is formed with a journal 5*b*, located at an axial position between the intermediate cylindrical journal portion 15*a* and the threaded end 15*b* of the cylindrical mounting base 15. The base 15 has an outer diameter slightly larger than the outer diameter front portion of the exhaust camshaft 5 extending within the cylindrical mounting base 15 and is in sliding contact with part of the inner surface of the cylindrical mounting base 15. The exhaust camshaft 5 is integrally formed with a hexagonal collar 5*c* for an open end wrench.

The variable valve timing mechanism 16 is of the well known hydraulic type and is activated by oil supplied thereto through an oil passage (not shown) formed in the exhaust camshaft 5 by an oil pump (not shown) of the engine 1 according to an engine operating condition. The vari-'le valve timing mechanism 16 includes the cylindrical casing 25 attached to the cylindrical mounting base 15. A front end ring 26 with a cover 38 bolted thereto is threadingly fitted into the cylindrical casing 25. A cylindrical spacer 27 is fastened to the front end of the exhaust camshaft 5 through a washer 28 by a securing member 29, such as a bolt, so as to attach the valve timing mechanism 16 securely to the exhaust camshaft 5.

The variable valve timing mechanism 16 includes, between the casing 25 and the spacer 27, a ring piston 30 having two cylindrical rings disposed in the axial direction. The rings are fixedly attached to each other by a plurality of fixing pins 31, arranged at regular circumferential angular spacings. The ring piston 30 is formed, on its inner and outer surfaces, with helical splines directed in opposite directions. To threadingly engage the cylindrical casing 25 and the spacer 27 with the piston 30, the cylindrical casing 25 is formed, on its inner surface, with helical splines. The spacer 27 is also formed, on its outer surface, with helical splines. The variable valve timing mechanism 16 includes a return coil spring 36 disposed between the cylindrical mounting base 15 and the ring piston 30 so as to force the ring piston 30 apart from the cylindrical mounting base 15 in the axial direction. To adjust the variable valve timing mechanism 16 to a preferred angular position relative to the exhaust camshaft 5, a knock pin 32, extending from the end of the exhaust camshaft 5, is fitted into an axial groove or slot 27*a* formed in the spacer 27.

In a variable valve timing unit 16 mounted in this way on the exhaust camshaft 5, when pressurized oil is introduced through the oil passage in the exhaust camshaft 5 and the securing bolt 29 and applied to the piston 30, the piston 30 is forced to the right, as viewed in FIG. 2, against the return spring 36. The spacer 27, secured to the exhaust camshaft 5, and the casing 25, attached with the camshaft sprocket 9, spline coupled to the piston 30, are, therefore, turned in opposite directions relative to each other. This changes the relative phase of rotation between the exhaust camshaft 5 and the camshaft sprocket 9.

To assemble the valve drive mechanism to the cylinder head 3 of the engine 1, after mounting the exhaust camshaft gear 12 and the lock nut 14 on the front portion of the exhaust camshaft 5, the exhaust camshaft 5 is placed on the end bearing 21*b* and the intermediate bearing 22 of the cylinder head 3. Then, after adjusting the exhaust camshaft gear 12 to a predetermined phase of rotation relative to the intake camshaft gear 13 fixedly attached to the intake camshaft 6, the intake camshaft 6 is placed on the front end bearing 21*b* and the intermediate bearing 22 of the cylinder head 3. As is well known in the art, the adjustment of the relative phase of rotation between the camshaft gears 12 and 13 of the exhaust and intake camshafts 5 is performed by aligning a mark on one of the camshaft gears 12 and 13 with a mark on the other of these camshaft gears.

The end bearing caps 18 and the intermediate bearing cap 22 are secured to the end bearings 21*a* and 21*b* and the intermediate bearing 22, respectively, so as to rotatably hold the camshafts 5 and 6. However, because no element of the variable valve timing unit 16 has yet been assembled in the valve drive mechanism, there remains a clearance between the exhaust camshaft 5 and the inner surfaces of the end bearings 21*a* and the end bearing caps 18. During securing of the camshafts 5 and 6, the exhaust camshaft gear 12 and the lock nut 14, which has been provisionally mounted on the exhaust camshaft 5, are located rearward from the end bearing 21*a* of the cylinder head 3. After securing the end bearing cap 18 to the end bearing 21*a*, the boss 12*a* of the exhaust camshaft gear 12 is fitted in the annular groove G so that the exhaust camshaft gear 12 is provisionally held, by the end bearing 21*a* and the end bearing cap 18, coaxially with the exhaust camshaft 5. After (or before) fitting the boss 12*a* of the exhaust camshaft gear 12 in the annular groove G, the oil sealing ring 24 is press-fitted in the internal circular groove F of the end bearing 21*a* and the end bearing cap 18, which have been secured to each other, through the clearance.

Thereafter, the variable valve timing unit 16 is mounted on the exhaust camshaft in such a way as to fit the cylindrical mounting base 15 between the exhaust camshaft 5 and the end bearing 21*a* and the end bearing cap 18 through the clearance to some extent. The variable valve timing unit 16 is then turned so as to align the internal axial slot 12*b* of the exhaust camshaft gear 12 with the positioning pin 23 of the rear cylindrical portion of the cylindrical mounting base 15. The cylindrical mounting base 15 is then forced axially until the knock pin 32 of the exhaust camshaft 5 abuts the rear end surface of the spacer 27. Because the exhaust camshaft gear 12 is held coaxially with and by the end bearing 21*a* and the end bearing cap 18, the insertion of the cylindrical mounting base 15 into the clearance between the exhaust camshaft 5, the end bearing 21*a* and the end bearing cap 18 is performed quite easily. Then, exhaust camshaft gear 12 is provisionally fastened against the annular groove G of the front end bearing 21*a* and the end bearing cap 18 by the lock nut 14.

After provisional fastening of the exhaust camshaft gear 12, the exhaust camshaft 5 is turned by the use of a tool, such as an open end wrench fitted to the hexagonal collar 5*c*, until the knock pin 32 of the exhaust camshaft 5 is set to (or aligned with) the axial slot 27*a* of the spacer 27. Because the securing bolt 29 and the cover 38 are not yet attached to the variable valve timing unit 16, the angular position of the exhaust camshaft 5 relative to the spacer 27 can be viewed and confirmed from the front side. The spacer 27 is then fastened to the front end of the exhaust camshaft 5 by the securing bolt 29 through the washer 28. After locking the knock nut 14 against rotation with respect to the front end bearing 21*a* by the use of a tool or an extra jig, the securing bolt 29 is further turned with a predetermined torque by the use of a torque wrench so as to fixedly secure the variable valve timing unit 16 to the exhaust camshaft 5. The lock nut 14 is further turned by the use of a special wrench so as to completely fasten the exhaust camshaft gear 12 to the cylindrical mounting base 15. Finally, the cover 38 is attached to the front end ring 26 of the variable valve timing unit 16 to complete the assembly of the valve drive mechanism.

The variable valve timing unit 16 is activated, according to engine load and engine speed, in a well known manner. That is, when the engine is operated at higher engine loads and higher engine speeds, pressurized oil is introduced into the variable valve timing unit 16 and applied to the piston 30. Consequently, the piston 30 is forced in one axial direction, for instance to the right, as viewed in FIG. 2. The casing 25, which is mechanically united to the camshaft sprocket 9 and the exhaust camshaft gear 12 as a whole, is turned through a predetermined angle relative to the exhaust camshaft 5 secured to the spacer 27. As a result of the change in angular position of the exhaust camshaft gear 12 relative to the exhaust camshaft 5, the phase of rotation of the intake camshaft 6 relative to the exhaust camshaft 5 changes, so as to retard closing of the intake valves or to advance opening of the exhaust valves. An overlap time period, during which both of the intake and exhaust valves remain open, is thereby extended. On the other hand, when the engine is operated at lower engine loads and lower engine speeds, pressurized oil is removed from the variable valve timing unit 16, so that the piston 30 returns to the left as viewed in FIG. 2. The camshaft sprocket 9 and the exhaust camshaft gear 12, therefore, are returned, as a whole, through the predetermined angle relative to the exhaust camshaft 5. As a result, the phase of rotation of the intake camshaft 6 relative tot he exhaust camshaft 5 changes, so as to advance closing the intake valves or to retard opening the exhaust valves. The overlap time period is thereby shortened.

The valve drive mechanism, equipped with the variable valve timing unit 16, may be assembled to the intake camshaft in the same manner as described above.

It is to be understood that although the present invention has been described with respect to a preferred embodiment thereof, various other embodiments and variants may occur to those skilled in the art. Any such other embodiments and variants which fall within the scope and spirit of the invention are intended to be covered by the following claims.

What is claimed is:

1. A method of assembling a valve driving mechanism to a double overhead camshaft engine having camshafts which are rotatably connected to each other by a gear train having at least two camshaft gears, said valve driving mechanism having a variable valve timing unit incorporated in a cylindrical mounting base which is rotatably mounted on one of said camshafts, said method comprising the steps of:

mounting, on said one of said camshafts, one of said at least two camshaft gears, the one of said at least two camshaft gears being maintained at a predetermined angular position relative to the other of said at least two camshaft gears, and a lock nut;

adjusting, while mounting said variable valve timing unit on said one of said camshafts, an angular position of said cylindrical mounting base relative to said one of said at least two camshaft gears and then an angular position of said variable valve timing unit relative to said one of said camshafts; and fastening said one of said at least two camshaft gears to said cylindrical mounting base with said lock nut and, simultaneously, said variable valve timing unit to said one of said camshafts.

2. A method as defined in claim 1, and further comprising the steps of provisionally fastening said one of said at least two camshaft gears to said cylindrical mounting base with said lock nut after adjusting the angular position of said cylindrical mounting base and completely fastening, simultaneously with fastening of said variable valve timing unit, said one of said at least two camshaft gears to said cylindrical mounting base with said lock nut after adjustment of the angular position of said variable valve timing unit.

3. A method of assembling a valve driving mechanism to a double overhead camshaft engine having camshafts which are rotatably connected to each other by a gear train having at least two camshaft gears, said valve driving mechanism having a variable valve timing unit incorporated in a cylindrical mounting base which is rotatably mounted on one of said camshafts, said method comprising the steps of:

placing said one of said camshafts, having one of said at least two camshaft gears and a lock nut mounted thereon, on a semi-circular bearing formed integrally with a cylinder head of said double overhead camshaft engine;

attaching a semi-circular bearing cap to said semi-circular bearing to form a cylindrical space between said bearing and said one of said camshafts;

holding said one of said at least two camshaft gears in said cylindrical space;

inserting said cylindrical mounting base into said cylindrical space so as to mount said variable valve timing unit on said one of said camshafts; and fastening said one of said at least two camshaft gears to said cylindrical mounting base with said lock nut and, simultaneously, said variable valve timing unit to said one of said camshafts.

4. A method as defined in claim 3, and further comprising the step of attaching a sealing ring to said semi-circular bearing for sealing between said bearing and said cylindrical mounting base before inserting said cylindrical mounting base into said cylindrical space.

* * * * *